US007547142B2

(12) United States Patent
Robinson et al.

(10) Patent No.: US 7,547,142 B2
(45) Date of Patent: Jun. 16, 2009

(54) SELF-CENTERING SLIDING BEARING

(75) Inventors: William Henry Robinson, Wellington (NZ); Christopher Ross Gannon, Wellington (NZ)

(73) Assignee: Robinson Seismic IP Limited, Lower Hutt (NZ)

( * ) Notice: Subject to any disclaimer, the term of this patent is extended or adjusted under 35 U.S.C. 154(b) by 224 days.

(21) Appl. No.: 10/548,193

(22) PCT Filed: Mar. 5, 2004

(86) PCT No.: PCT/NZ2004/000045

§ 371 (c)(1),
(2), (4) Date: Jun. 26, 2006

(87) PCT Pub. No.: WO2004/079113

PCT Pub. Date: Sep. 16, 2004

(65) Prior Publication Data

US 2006/0272226 A1 Dec. 7, 2006

(30) Foreign Application Priority Data

Mar. 7, 2003 (NZ) ..... 524611

(51) Int. Cl.
*F16C 31/02* (2006.01)
*F16C 41/00* (2006.01)
*E04H 9/02* (2006.01)

(52) U.S. Cl. ..... 384/36; 384/38; 248/560; 52/167.4

(58) Field of Classification Search ..... 384/26–27, 384/34, 36–38; 248/636–638, 562, 694, 248/560, 580; 52/167.4, 167.5, 167.9; 29/898.3, 29/898.042
See application file for complete search history.

(56) References Cited

U.S. PATENT DOCUMENTS 2,014,643 A 8/1935 Bakker (Continued)

FOREIGN PATENT DOCUMENTS

DE 295 03 801 6/1995

(Continued)

OTHER PUBLICATIONS

Patent Abstracts of Japan, 2002-195345, Jul. 10, 2002, 1 pg., Daido Metal Co., Ltd.

(Continued)

*Primary Examiner*—Marcus Charles
(74) *Attorney, Agent, or Firm*—Jacobson Holman PLLC

(57) ABSTRACT

A bearing assembly having upper and lower bearing seats and a sliding load bearing member between the seats. The sliding member is fitted with an elastic self-centering element. The assembly in operation damps relative horizontal movement between the upper and lower seats, the self-centering element returning the sliding member to a centered position at rest. Typically a structure rests upon and is secured to the upper seat and the lower seat rests upon or is fixed to a foundation. The relative horizontal movement may be caused by earthquakes, wind loads or the like.

19 Claims, 4 Drawing Sheets

U.S. PATENT DOCUMENTS

| | | | | | |
|---|---|---|---|---|---|
| 3,633,855 | A | * | 1/1972 | Nell | 248/694 |
| 4,320,549 | A | * | 3/1982 | Greb | 14/73.5 |
| 4,596,373 | A | * | 6/1986 | Omi et al. | 248/562 |
| 4,644,714 | A | | 2/1987 | Zayas | 52/167 |
| 4,662,133 | A | | 5/1987 | Kondo | 52/167 |
| 5,261,200 | A | | 11/1993 | Sasaki et al. | 52/167 |
| 5,597,239 | A | | 1/1997 | Scaramuzza | 384/36 |
| 5,867,951 | A | * | 2/1999 | Yaguchi et al. | 52/167.4 |
| 6,021,992 | A | | 2/2000 | Yen et al. | 248/560 |
| 6,052,955 | A | | 4/2000 | Haider | |
| 6,123,313 | A | * | 9/2000 | Otsuka et al. | 248/580 |
| 6,126,136 | A | | 10/2000 | Yen et al. | 248/560 |
| 6,289,640 | B1 | | 9/2001 | Ueda et al. | 52/167 |
| 2004/0131287 | A1 | * | 7/2004 | Lee et al. | 384/36 |

FOREIGN PATENT DOCUMENTS

| | | | | |
|---|---|---|---|---|
| DE | 101 45 857 | | | 2/2003 |
| EP | 0439272 | A2 | | 7/1991 |
| EP | 0889179 | A1 | | 1/1999 |
| GB | 2099932 | A | | 12/1982 |
| JP | 60-70276 | | | 4/1985 |
| JP | 64-18810 | | | 1/1989 |
| JP | 01043643 | A | * | 2/1989 |
| JP | 01146042 | A | * | 6/1989 |
| JP | 09014345 | A | * | 1/1997 |
| JP | 11350783 | | * | 12/1999 |
| JP | 2000064657 | A | * | 2/2000 |
| JP | 2000257670 | A | * | 9/2000 |
| JP | 2000283230 | A | * | 10/2000 |
| JP | 2001074094 | A | * | 3/2001 |
| JP | 2002021927 | A | * | 1/2002 |
| JP | 2002061414 | A | * | 2/2002 |
| JP | 2002115419 | A | * | 4/2002 |
| JP | 2002276194 | A | * | 9/2002 |
| JP | 2002295054 | A | * | 10/2002 |
| JP | 2002364704 | A | * | 12/2002 |
| WO | WO94/15047 | | | 7/1994 |
| WO | WO 00/37823 | | | 6/2000 |
| WO | WO02/084030 | | | 10/2002 |

OTHER PUBLICATIONS

Patent Abstracts of Japan, 11-236944, Aug. 31, 1999, 2 pgs., Kaimon:KK.

Patent Abstracts of Japan, Accession No. 97/162189, JP 09-031919 A (Kaimon KK), Feb. 4, 1997.

Patent Abstracts of Japan, Accession No. 98-182569, JP 10-038022 A (Shindo Tomiharu), Feb. 13, 1998.

* cited by examiner

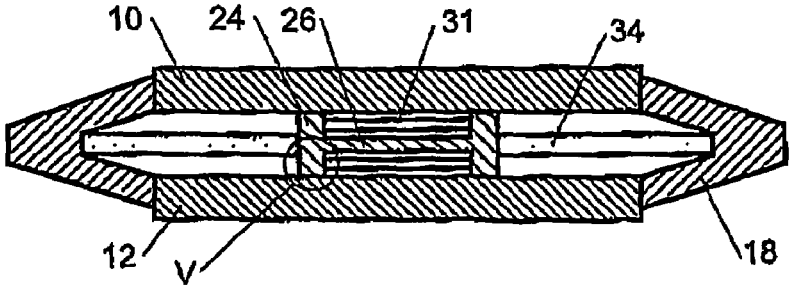
FIGURE 3
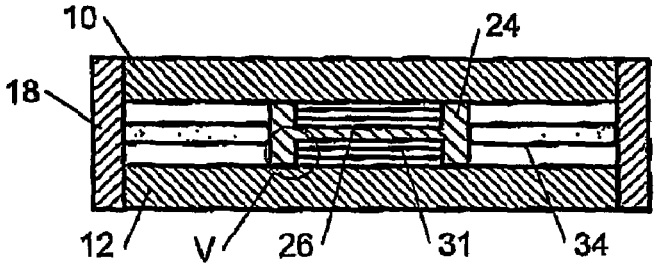
FIGURE 4
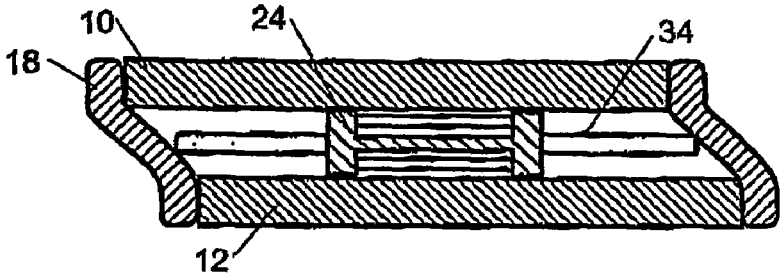
FIGURE 4a
FIGURE 5
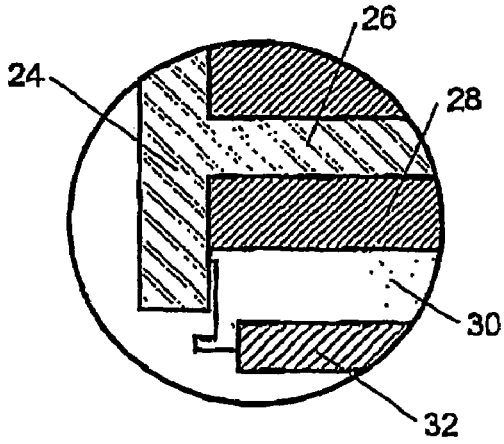

SELF-CENTERING SLIDING BEARING

This is a nationalization of PCT/NZ04/000045 filed 5 Mar. 2004 and published in English.

FIELD OF THE INVENTION

This invention relates to sliding bearings. More particularly it relates to sliding bearings with elastic self-centring. In a preferred embodiment sliding bearings according to the invention may be used in seismic isolation, but they may be used in other applications to dampen relative movement between a structure and another structure or ground supporting the first structure.

BACKGROUND OF THE INVENTION

In the field of seismic isolation the use of sliding bearings is well known. One known type of sliding bearing is a bearing assembly having upper and lower bearing seats and a load bearing sliding member between the seats, the member being able to slide relative to both seats. Examples of such bearing assemblies are in U.S. Pat. No. 4,320,549; U.S. Pat. No. 5,597,239, U.S. Pat. No. 6,021,992, and U.S. Pat. No. 6,126,136.

In another type of sliding bearing the sliding member is fixed to one or other upper or lower bearing seat. In such an embodiment the sliding member is may be a pillar projecting from the bearing seat to which it is affixed. It is usually the upper seat which is movable relative to the slider member. Examples of this type of sliding bearing are found in U.S. Pat. No. 4,644,714; U.S. Pat. No. 5,867,951; U.S. Pat. No. 6,289,640; the embodiments shown in each of FIGS. 4 to 6 in U.S. Pat. No. 6,021,992; and the embodiments shown in FIGS. 4 and 5 of U.S. Pat. No. 6,126,136.

Some of the above mentioned sliding bearings have a curved bearing seat surface and a corresponding curved surface on the sliding element which provide a form of passive self-centring of the sliding element and the bearing seats. None of either types of sliding bearings mentioned above have elastic self-centring.

"Self-centring" is, for the purposes of this specification, urging the sliding element and the upper and lower bearing seats to remain in or return to substantially symmetrical alignment with the longitudinal axis passing through the upper and lower bearing seats and the sliding element perpendicular to a horizontal plane.

An advantage of elastic self-centring is that it provides a means to control the elastic shear stiffness of the bearing to ensure that the isolated structure has a natural period which exceeds the period of the seismic event or other horizontal forces which the bearing assembly is designed to damp so as to enhance the effectiveness of the seismic isolation.

Another advantage, particularly when the sliding member is movable with respect to both the upper and lower bearing seats, is that a bearing assembly may be constructed of a reduced cross sectional area in comparison with a bearing assembly without elastic self-centring. The sliding member in FIGS. 2, 3 and 7 is at rest at the midpoint between the upper and lower seats.

SUMMARY OF THE INVENTION

It is an object of this invention to go some way towards achieving these desiderata or at least to offer the public a useful choice.

Accordingly, the invention may be said broadly to consist in a bearing assembly comprising:

an upper bearing seat, a lower bearing seat and a sliding load bearing member there between, the sliding member optionally being fixed to one or other of the upper and lower bearing seats, friction between the sliding member and the upper or lower bearing seats, or between the sliding member and the upper and lower bearing seats, in use, damping relative horizontal movement between the upper bearing seat and the lower bearing seat, the assembly, when the sliding member is fixed to one or other of the upper or lower bearing seats further comprising an elastic sleeve surrounding the outer peripheries of the upper and lower seats co-operable with the upper or lower bearing seats to urge the seat to which the sliding member is not fixed to return to or remain in a centred position relative to the sliding member and the seat to which the sliding member is fixed.

In another embodiment the invention may be said broadly to consist in a bearing assembly comprising:

an upper bearing seat, a lower bearing seat and a sliding load bearing member therebetween, the sliding member optionally being fixed to one or other of the upper and lower bearing seats, friction between the sliding member and the upper or lower bearing seat, or between the sliding member and the upper and lower bearing seats, in use, damping relative horizontal movement between the upper bearing seat and the lower bearing seat, the assembly further comprising a diaphragm, the sliding member being located at or near or joined to the centre of the diaphragm, the periphery of the diaphragm being joined to or adjacent to the periphery of one or both of the upper and lower bearing seats co-operable with the sliding means and one or other or both of the upper and lower bearing seats to urge the sliding means to return to or remain in a centered position.

In one embodiment the sliding member is not fixed to either of the upper or lower bearing seats.

In another embodiment, wherein the sliding member is not fixed to either the upper or lower bearing seats, the self-centring means comprises two diaphragms.

In another embodiment the elastic self-centring means includes both a sleeve over the outer periphery of the upper and lower bearing seats and one or two diaphragms.

Preferably the diaphragm or the two diaphragms comprises or comprise vulcanized rubber.

The invention also consists in a bearing assembly comprising:

an upper bearing seat, a lower bearing seat and a sliding load bearing member there-between, the sliding member being slideable relative to each of the upper and lower bearing seats, friction between said sliding member and the upper and lower bearing seats, in use, damping relative horizontal movement between the upper bearing seat and the lower bearing seat, the assembly further comprising an elastic self-centring means comprising a sleeve over the outer periphery of and co-operable with the upper and lower bearing seats to urge the seats to return to or remain in a centered position relative to the sliding member and a rigid member extending peripherally outwardly from the slider to cooperate with the sleeve to centre the slider between the upper and lower seats.

In one alternative said rigid member is affixed to the elastic sleeve and abuts the sliding member.

In one embodiment the rigid member is a disc.

In another embodiment the rigid member is a hub and a plurality of spokes.

Alternatively the sliding member is substantially cylindrical in shape and the bearing surfaces of the lower and upper bearing seats are substantially flat.

Preferably the sliding member is of regular geometrical shape in cross-section.

Alternatively one or other of the bearing surfaces of the upper or lower bearing seats is curved and the corresponding bearing surface of the sliding member is curved to cooperate therewith.

Preferably the diaphragm is made of vulcanized rubber.

Preferably the sleeve is made of vulcanized rubber or other appropriate elastic material.

The invention may also be said broadly to consist in a method for seismically isolating a structure which comprises installing a bearing assembly as herein above defined between the structure and a foundation.

In one alternative the foundation is another structure.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention may be more fully understood by having reference to the accompanying drawings wherein:

FIG. 3 is a sectional view of a further embodiment of the invention in which elastic self-centring means is provided by a peripheral sleeve and a sliding member with a rigid peripheral projection extending to the rubber sleeve and beyond the peripheries of the upper and lower bearing seats.

FIG. 4 is a sectional view of an alternative to the embodiment in FIG. 3 in which the rigid projection from the sliding member does not extend beyond the periphery of the upper and lower bearing seats.

FIG. 4*a* shows the embodiment in FIG. 4 in use with the lower bearing seat moved horizontally relative to the upper bearing seat.

FIG. 5 is the detail shown in the circle V in each of FIGS. 3 and 4.

DETAILED DESCRIPTION OF THE PREFERRED EMBODIMENTS

Construction of First Embodiment

Figure 1:
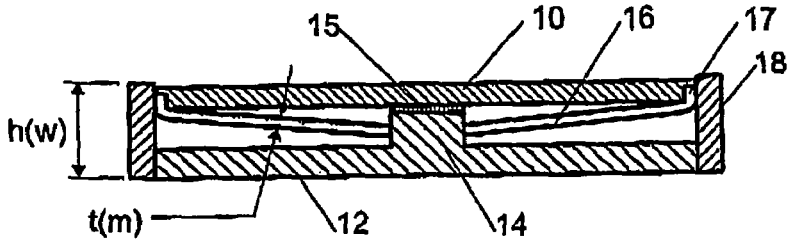
FIG. 1 is a sectional view of one embodiment of the invention in which a sliding element is fixed to the lower bearing seat and elastic self-centring is provided by both a diaphragm and a sleeve.

A bearing assembly according to a first embodiment of the invention is illustrated in FIG. 1. This embodiment has a lower bearing seat 12, preferably made of stainless steel, from which projects a sliding member 14. There is a layer of polytetrafluoroethylene (PTFE) or other suitable sliding material 15 on the load bearing upper face of sliding member 14.

The upper bearing seat 10 is also made of stainless steel. Its face is substantially flat and rests on the PTFE layer 15 of sliding member 14.

Bearing seats 10 and 12 may be of any regular geometrical shape in cross-section. In one preferred embodiment they are circular in cross-section.

Surrounding the outer periphery of upper bearing seat 10 and lower bearing seat 12 is a sleeve 18, preferably of vulcanized rubber.

Also provided is a diaphragm 16 made of vulcanized rubber. In the embodiment illustrated the diaphragm 16 has a central hole of diameter slightly smaller of that sliding member 14 so as to be able to slide over and remain in place on sliding member 14. The outer periphery of diaphragm 16 is fitted within a recess 17 on the outer face of bearing seat 10 by sleeve 18. However, it may be clamped into place by a metal ring or by other means known to those skilled in the art.

Figure 1A:
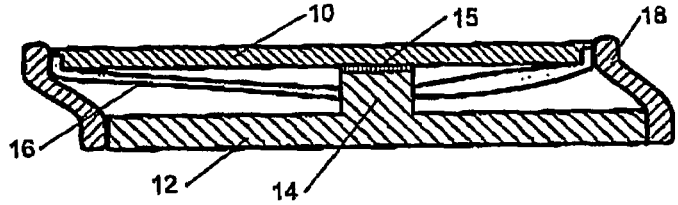
FIG. 1*a* shows the embodiment of FIG. 1 displaced in the course of an earthquake.
Figure 1B:
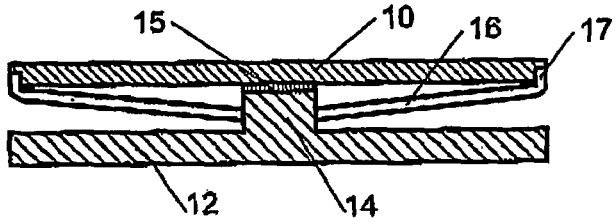
FIG. 1*b* shows a variation of the embodiment shown in FIG. 1 where there is only a diaphragm providing elastic self-centring.
Figure 1C:
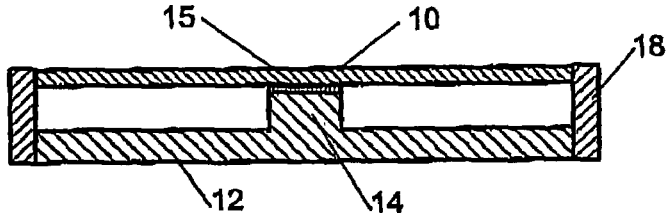
FIG. 1*c* shows a variation of the embodiment shown in FIG. 1 where there is only a sleeve providing elastic self-centring.

In the embodiments illustrated in FIGS. 1 and 1*a* the elastic self-centring forces are provide by a combination of sleeve 18 and diaphragm 16. However, self-centring can be achieved by a sleeve alone or a diaphragm alone. In the embodiment shown in FIG. 1*b* the self-centring means is a diaphragm 16. In FIG. 1*c* it is a sleeve 18. These are exemplary of alternatives to the embodiments shown in FIGS. 2, 6 and 7 as well.

Sleeve 18 may contain annular reinforcing rings of stiffing material embedded into the rubber of the sleeve. These serve to stabilize the sleeves during large displacement by spreading the displacements more equally.

Construction of Second Embodiment

Figure 2:
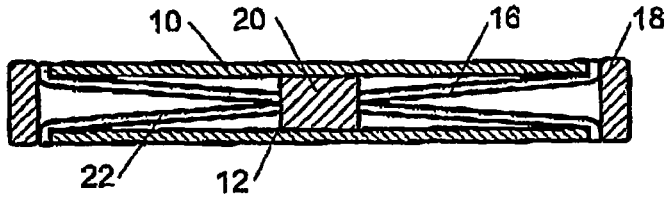
FIGS. 2 and 2*a* are sectional views of another embodiment of the invention in which the sliding element is movable relative to both the upper and lower bearing seats and two diaphragms and a peripheral sleeve providing elastic self-centring means.

The construction of a second embodiment of the invention is illustrated in FIG. 2. In the embodiment illustrated in FIG. 2 upper and lower bearing seats 10 and 12 are of similar construction to the seats in FIG. 1. The difference is that lower bearing seat 12 has a continuous flat load bearing surface. Between the bearing seats is a sliding member 20. In a preferred embodiment this sliding member 20 is a cylinder made of PTFE. It is able to move horizontally relative to both the upper bearing seat 10 and the lower bearing seat 12.

In this embodiment there are a pair of rubber diaphragms 16 and 22, each having a central hole through which the sliding member 20 is fitted in a snug fit. The peripheries of diaphragms 16 and 22 are held in recesses at the outer peripheries of bearing seats 10 and 12 by a rubber sleeve 18 as with the embodiment illustrated in FIG. 1.

Construction of Third Embodiment

A third embodiment is illustrated in FIG. 3. In this embodiment the sliding member is an annulus 24 having a central web 26, preferably of stainless steel. As illustrated in detail in FIG. 5 in the recesses 31 defined below and above web 26 within annulus 24 there is a laminated construction. This consists of a rubber layer 28 secured to the web 26 inside of the annulus 24. A second layer 30, preferably of stainless steel with a recess in its lower face is affixed to the rubber layer 28. The lower bearing seat contacting surface is disc shaped PTFE insert 32. The same laminated structure is provided above web 26. Thus the load bearing surfaces of the sliding element in the embodiment in FIG. 3 which contact the faces of the upper bearing seat 10 and the lower bearing seat 12 are of each of PTFE.

There is also provided projecting outwardly from the sliding element in the assembly of FIG. 3 a disc 34. The outer periphery of disc 34 extends outwardly beyond the outer peripheries of upper bearing seat 10 and lower bearing seat 12. A rubber sleeve 18 extends over the peripheral edge of disc 34 as well as around the peripheral edges of upper bearing seat 10 and lower bearing seat 12.

Construction of Fourth Embodiment

The embodiment illustrated in FIG. 4 is substantially the same as that in FIG. 3 except that the outer periphery of disc 34 lies substantially in vertical registry with the outer peripheries of upper bearing seat 10 and lower bearing seat 12 respectively. This is in contrast to the disc 34 in the embodiment in FIG. 3 which extends peripherally beyond the peripheries of seats 10 and 12.

Disc 34 serves as a rigid connection between sleeve 18 and the sliding member. The invention contemplates other mechanical equivalents. Instead of a solid disc 34, a perforated disc may be used. It would also be possible to have spokes extending outwardly from annulus 24. It is equally contemplated that a disc 34 may be attached to the inner surface of sleeve 18 and not attached to the slider. In such an embodiment perforated discs or spokes with inner and outer annular rims could also be employed for the same purpose.

Construction of Fifth Embodiment

Figure 6:
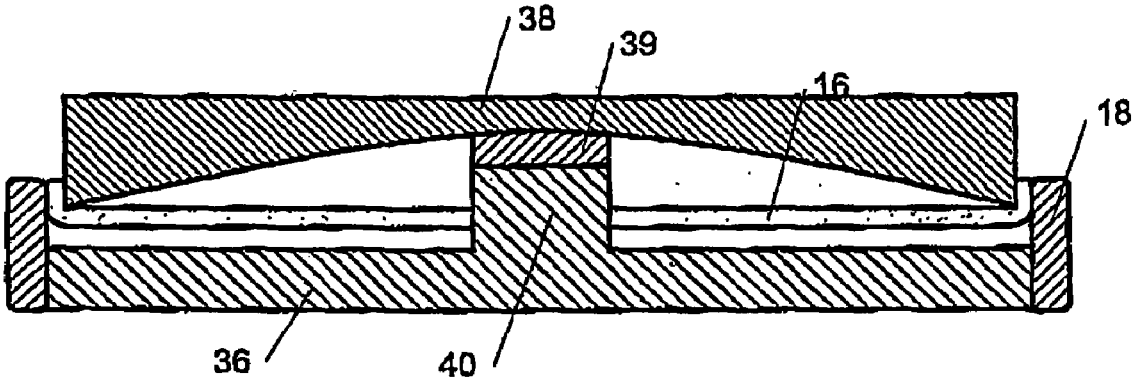
FIG. 6 is a sectional view of an embodiment of the invention similar to that shown in FIG. 1 but with the bearing face of the upper bearing seat being curved.

The embodiment illustrated in FIG. 6 is substantially the same as that in FIG. 1. It consists of a lower bearing seat 36 from which projects a sliding member 40 having a PTFE load bearing surface 39 at its upper end. In the assembly of FIG. 6 the bearing face of the upper bearing seat 38 is spherical rather than flat. The load bearing surface 39 of the sliding member 40 has a convex spherical curve which corresponds to the concave spherical curve of the load bearing surface of upper bearing seat 38.

The diaphragm 16 and the sleeve 18 are of the same material and construction of those described in the embodiment illustrated in FIG. 1.

Construction of Sixth Embodiment

Figure 7:
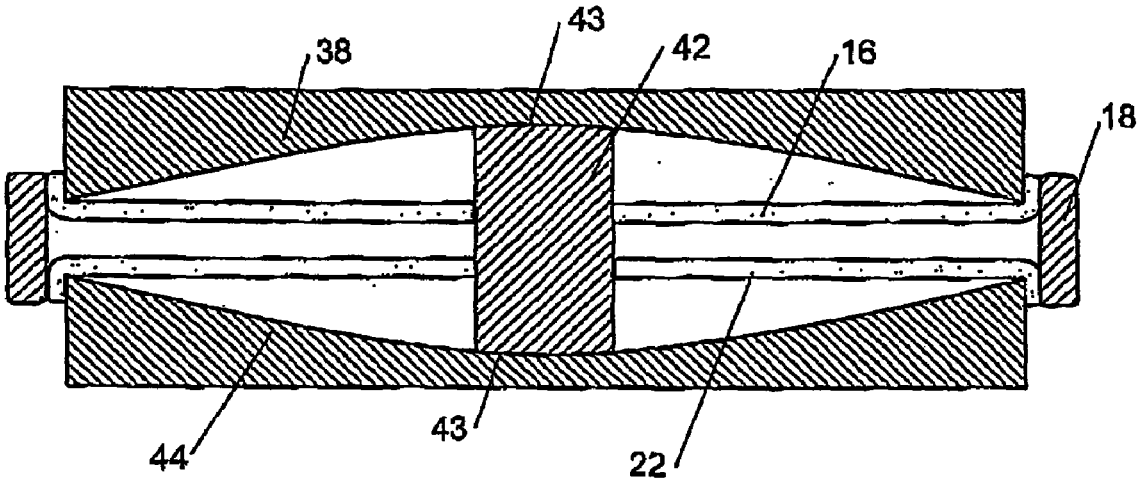
FIG. 7 is a sectional view of a bearing assembly similar to that shown in FIG. 2 but with the bearing faces of the upper and lower bearing seats being curved.

The embodiment illustrated in FIG. 7 is similar in construction to that illustrated in FIG. 2. However, as with the embodiment in FIG. 6 the load bearing surface of the upper bearing seat 38 is spherical as is the load bearing surface of the lower bearing seat 44. The sliding member 42 has hemispherical load bearing end surfaces 43 of shape which corresponds to the inner surface of the upper and lower bearing seats 38 and 44.

Diaphragms 16 and 22 and sleeve 18 illustrated in FIG. 7 are of the same materials and construction as the corresponding diaphragms and sleeve described in relation to FIG. 2.

Construction of Seventh Embodiment

Figure 8:
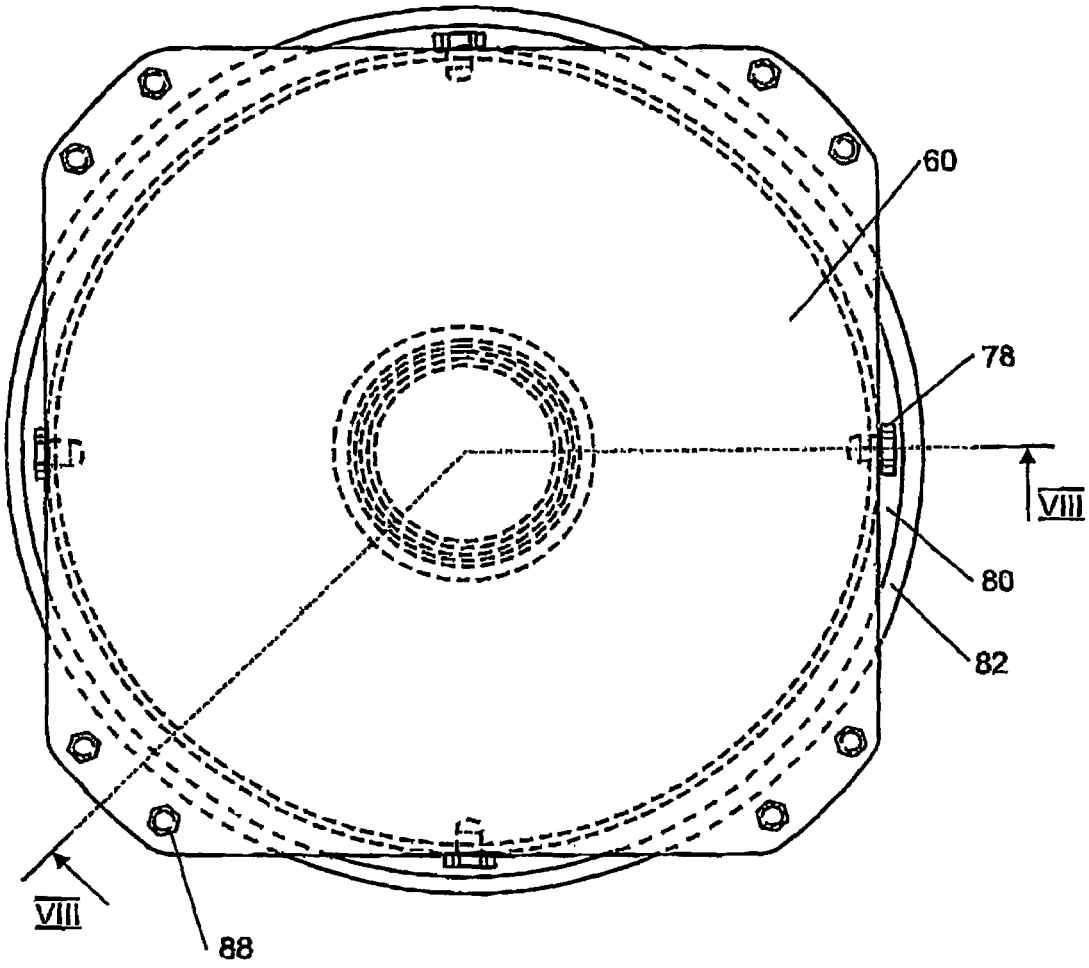
FIG. 8 is a plan view of a further embodiment of a bearing according to the invention.
Figure 9:
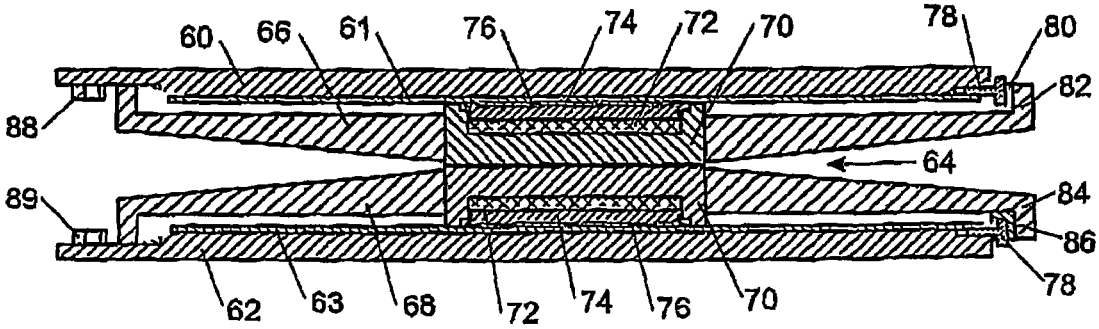
FIG. 9 is a side sectional view shown by the section line VIII-VIII in FIG. 8.

In the embodiment illustrated in FIGS. 8 and 9 the bearing has an upper plate 60 on which a structure may rest and a lower plate 62 which may rest on a foundation or further structure. The inward faces 61 and 63 of the plates 60 and 62 are coated with stainless steel.

The sliding member 64 consists of an opposed pair of annulus halves 70 similar to the annulus illustrated in FIGS. 3 to 5. As with the previous construction in a recess in each annulus half there is inserted, progressing outwardly, three layers. The innermost layer 72 is of rubber. The next layer 74 is of steel and the outer face 76 is of PTFE.

The self-centring for this bearing is provided by upper diaphragm 66 and lower diaphragm 68 which are fitted over the sliding member 64 in much the same manner as the diaphragms 16 and 22 in FIG. 2.

The outer periphery 82 of upper diaphragm 66 is fitted over a rim 80. There are provided a set of four bolts 78 as illustrated in FIG. 11 which secure the diaphragm edge 82 to rim 80 and rim 80 to upper plate 60. Similarly a set of four bolts 78 secures diaphragm edge 84 to rim 86 and rim 86 to lower plate 62.

Bolts (not illustrated) passed through holes in plates 60 and 62 may be threaded into nuts 88 and 89 in order to secure a structure to other plate 60 and to secure lower plate 62 to a foundation or a further structure.

Operation of First Embodiment

The embodiment in FIG. 1 is illustrated in operation in FIG. 1*a*. An external force, such as an earthquake, has moved lower bearing seat 12 to the position illustrated. This relative horizontal movement between the upper bearing seat 10 and the lower bearing seat 12 is damped by the friction between the upper surface 15 of sliding member 14 and the inner surface of bearing seat 10.

It will be seen that sleeve 18 has been stretched both on the right and left sides of the bearing assembly. The elasticity in the sleeve 18 will urge the support bearing seat 10 to return to the rest position shown in FIG. 1. Similarly the left hand portion of diaphragm 16 is stretched while the right hand portion is slack. While the relative movement between the upper and lower bearing seats is being damped by the friction between the sliding element 14 and the upper bearing seat 10, both the sleeve 18 and the diaphragm 16 will urge the sliding member 14 and the upper valve seat 10 to the centred position illustrated in FIG. 1.

Although the embodiment illustrated in FIG. 1 has both a diaphragm 16 and a sleeve 18 other embodiments within the scope of the invention can include an assembly which has only a diaphragm 16 and another assembly which has only an elastic sleeve 18.

Operation of Second Embodiment

Figure 2A:
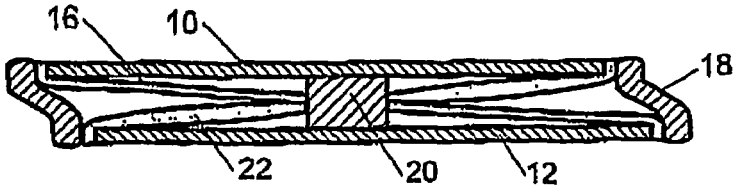

In the embodiment illustrated in FIG. 2*a* the elastic self-centring force from both the elastic sleeve 18 and the pairs of diaphragms 16 and 22 will urge the sliding member 20 and the bearing seats 10 and 12 to a centred position. The left side of diaphragm 22 is slack and the right side is stretched in FIG. 2*a*. Diaphragm 16 is stretched and slack in the same manner as is illustrated in FIG. 1*a*.

Operation of Third and Fourth Embodiments

Referring to FIG. 4*a*, an earthquake force has displaced the lower bearing seat 12 to the right. Frictional forces between the load bearing faces of sliding member 24 and the load bearing faces of seats 10 and 12 will damp the relative movements between the seats. Elastic sleeve 18 will urge both the upper and lower bearing seats and the disc 34 into a centered position.

Operation of Fifth and Sixth Embodiments

In the embodiments illustrated in FIGS. 6 and 7 the curved surfaces of the bearing seats add additional passive centring forces to the elastic self-centring provided by the diaphragms 16 and 22 and the sleeve 18.

Operation of Seventh Embodiment

The embodiment illustrated in FIGS. 8 and 9 operates in the manner of the second embodiment illustrated in FIGS. 2 and 2*a*.

ADVANTAGES

One advantage provided by elastic self-centring of a seismic sliding bearing is that it provides a means for controlling the period of the isolated structure so that the period of the isolated structure exceeds the period of the earthquake. In seismic isolation this is better known as period shift. The concept is more full described in "Introduction to Seismic Isolation", Skinner et al., John Wiley & Sons, (1993), pages 4 to 7.

Another advantage is that it minimizes the cross sectional area occupied by the bearing assembly. The advantages of the bearing assembly illustrated in FIGS. 2, 4, and 7 that they are double acting. That is, the top and the bottom seats 10 and 12 move in opposite directions relative to the sliding member thereby reducing the required size of the sliding surface of the bearing seats by a factor of two.

The total horizontal force required to operate the bearing assembly F(horizontal) is given by the sum of the force to overcome the friction, F(μ), the force to deform the rubber diaphragm, F(m), plus the forces required to deform the rubber sleeve, F(w). The forces to deform the rubber are mainly elastic in nature.

Thus:

$$F(\text{horizontal})=F(\mu)+F(m)+F(w)$$

Where $$F(\mu)=\mu F(\text{vertical})$$

$$F(m)\approx[\alpha\cdot E(\text{rubber})\cdot\tau(m)]x$$

$$F(w)\approx[\alpha\cdot E(\text{rubber})+\beta\cdot G(\text{rubber})]\cdot[A(w)/h(w)]x$$

Where

μ=the coefficient of friction between the two sliding surfaces $$F(\text{vertical})=(\text{total mass})\cdot g$$

t(m)=thickness of the diaphragm (see FIG. 1)

x=horizontal displacement of the top seat relative to the bottom seat, where x=0 when the seats are centred.

α=a geometric term for the diaphragm

β=a geometric term for the sleeve

E(rubber)=Young's modulus for the rubber diaphragm

G(rubber)=the shear modulus of the rubber sleeve

A(w)=the cross sectional area of the sleeve h(w)=the height of the sleeve (see FIG. 1)

One of the applications of the bearing assembly is as a support for seismic isolation. Seismic isolation is the technique whereby the natural period of oscillation of the structure is increased to a value beyond that of the main period of the earthquake together with a optimum value of damping. Optimum values of these two factors enable a reduction in the acceleration transmitted to the structure by a factor of at least two.

The bearing assembly of this invention is a compact self contained unit which can be designed to maximise the effectiveness of seismic isolation.

What is claimed is:

1. A bearing assembly comprising:

an upper bearing seat, a lower bearing seat, and a sliding load bearing member therebetween, said sliding load bearing member having an upper surface in sliding contact with a bearing surface of the upper bearing seat and a lower surface in sliding contact with a bearing surface of the lower bearing seat such that said sliding load bearing member is slideable relative to said upper and lower bearing seats, friction between said upper surface of said sliding load bearing member and said bearing surface of said upper bearing seat and between said lower surface of said sliding load bearing member and said bearing surface of said lower bearing seat, in use, damping relative horizontal movement between said upper bearing seat and said lower bearing seat, said assembly having an elastic self-centering device cooperable with the upper bearing seat, lower bearing seat, and the sliding load bearing member to urge said sliding load bearing member to return to or remain in a centered position, the elastic self-centering device includes two diaphragms, said sliding load bearing member being located at or near or joined to a center of said diaphragms, a periphery of each diaphragm being joined to or adjacent to a periphery of a respective one of said upper and lower bearing seats, the diaphragms being cooperable with said sliding load bearing member and said upper and lower bearing seats to urge said sliding load bearing member to return to or remain in a centered position.

2. The bearing assembly as claimed in claim 1, wherein said two diaphragms include vulcanized rubber.

3. The bearing assembly as claimed in claim 1, wherein each diaphragm has a thickness that reduces from the center to the periphery.

4. The bearing assembly as claimed in claim 1, wherein said sliding load bearing member has a width and a depth extending between said bearing surfaces of said upper and lower bearing seats, with the width being greater than the depth, and said bearing surfaces of said upper and lower bearing seats are flat and said upper and lower surfaces of said sliding load bearing member are flat.

5. The bearing assembly as claimed in claim 1, wherein said sliding load bearing member includes a multi-layer construction having layers of resilient material and layers of more rigid material.

6. The bearing assembly as claimed in claim 1, wherein at least one of the bearing surfaces of said upper or lower bearing seats is curved and a corresponding bearing surface of said sliding member is curved to cooperate therewith.

7. The bearing assembly as claimed in claim 1, wherein each diaphragm extends generally radially outwardly from its center to its periphery, when the upper and lower bearing seats and sliding load bearing member are in a centered position.

8. The bearing assembly as claimed in claim 7, wherein when the upper and lower bearing seats and sliding load bearing member are not in a centered position, one side of each diaphragm is stretched, and the other side of the respective diaphragm is slack.

9. The bearing assembly as claimed in claim 1, wherein the sliding load bearing member is configured to slide as a single unit relative to the upper and lower bearing seats.

10. A bearing assembly comprising:

an upper bearing seat, a lower bearing seat, and a sliding load bearing member therebetween, said sliding load bearing member having an upper surface in sliding contact with a bearing surface of the upper bearing seat and a lower surface in sliding contact with a bearing surface of the lower bearing seat such that said sliding load bearing member is slideable relative to said upper and lower bearing seats, friction between said upper surface of said sliding load bearing member and said bearing surface of said upper bearing seat and between said lower surface of said sliding load bearing member and said bearing surface of said lower bearing seat, in use, damping relative horizontal movement between said upper bearing seat and said lower bearing seat, said assembly having an elastic self-centering device cooperable with the upper bearing seat, lower bearing seat, and the sliding load bearing member to urge said sliding load bearing member to return to or remain in a centered position, wherein the elastic self-centering device includes two diaphragms, said sliding load bearing member is located at or near or joined to a center of said diaphragms, a periphery of each diaphragm is joined to or adjacent to a periphery of a respective one of said upper and lower bearing seats, the diaphragms being cooperable with said sliding load bearing member and said upper and lower bearing seats to urge said sliding load bearing member to return to or remain in a centered position, the elastic self-centering device including a sleeve over an outer periphery of said upper and lower bearing seats and co-operable with said upper and lower bearing seats to urge said seats to return to or remain in a centered position relative to said sliding load bearing member, and said two diaphragms.

11. The bearing assembly as claimed in claim 10, wherein said sleeve is made of one of vulcanized rubber and elastic material.

12. A bearing assembly comprising:

an upper bearing seat, a lower bearing seat, and a sliding load bearing member therebetween, said sliding load bearing member having an upper surface in sliding contact with a bearing surface of the upper bearing seat and a lower surface in sliding contact with a bearing surface of the lower bearing seat such that said sliding load bearing member is slideable relative to said upper and lower bearing seats, friction between said upper surface of said sliding load bearing member and said bearing surface of said upper bearing seat and between said lower surface of said sliding load bearing member and said bearing surface of said lower bearing seat, in use, damping relative horizontal movement between said upper bearing seat and said lower bearing seat, said assembly having an elastic self-centering device cooperable with the upper bearing seat, lower bearing seat, and the sliding load bearing member to urge said sliding load bearing member to return to or remain in a centered position, said elastic self-centering device including a sleeve over an outer periphery of and co-operable with said upper and lower bearing seats to urge said seats to return to or remain in a centered position relative to said sliding load bearing member, and a rigid member extending peripherally outwardly from said sliding load bearing member to cooperate with said sleeve to center said sliding load bearing member between said upper and lower seats.

13. The bearing assembly as claimed in claim 12, wherein said rigid member is affixed to said sleeve and abuts said sliding member.

14. The hearing assembly as claimed in claim 12, wherein said rigid member is a disc.

15. The bearing assembly as claimed in claim 12, wherein said rigid member includes a hub and a plurality of spokes.

16. The bearing assembly as claimed in claim 12, wherein said sliding member, other than said rigid member, is cylindrical in shape and the bearing surfaces of said lower and upper bearing seats are flat.

17. The bearing assembly as claimed in claim 12, wherein said sliding member is of regular geometrical shape in cross-section.

18. The bearing assembly as claimed in claim 12, wherein said sleeve is made of one of vulcanized rubber and elastic material.

19. The bearing assembly as claimed in claim 12, wherein the sliding load bearing member is configured to slide as a single unit relative to the upper and lower bearing seats.

* * * * *